US011834982B2

(12) United States Patent
Homison et al.

(10) Patent No.: US 11,834,982 B2
(45) Date of Patent: Dec. 5, 2023

(54) INVERTED COMPRESSOR FOR ELECTRIC TURBOCHARGER

(71) Applicant: Transportation IP Holdings, LLC, Norwalk, CT (US)

(72) Inventors: Christopher Homison, Wattsburg, PA (US); Louis Kobielski, Sherman, NY (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 0 days.

(21) Appl. No.: 18/146,169

(22) Filed: Dec. 23, 2022

(65) Prior Publication Data

US 2023/0258121 A1 Aug. 17, 2023

Related U.S. Application Data

(60) Provisional application No. 63/268,106, filed on Feb. 16, 2022.

(51) Int. Cl.

| | |
|---|---|
| ***F02B 33/40*** | (2006.01) |
| ***F02B 39/10*** | (2006.01) |
| ***F04D 25/02*** | (2006.01) |
| ***F02B 37/10*** | (2006.01) |
| ***F04D 25/04*** | (2006.01) |

(52) U.S. Cl.

CPC ..... *F02B 39/10* (2013.01); *F02B 33/40* (2013.01); *F04D 25/024* (2013.01); *F05D 2220/40* (2013.01)

(58) Field of Classification Search

CPC ..... F02B 39/10; F02B 33/40; F04D 25/024

See application file for complete search history.

(56) References Cited

U.S. PATENT DOCUMENTS

| | | | | |
|---|---|---|---|---|
| 4,008,010 | A * | 2/1977 | Fauconnet | F03B 3/10 415/910 |
| 2007/0122296 | A1 | 5/2007 | Arnold et al. | |
| 2012/0186247 | A1 | 7/2012 | Marques et al. | |
| 2017/0328269 | A1 * | 11/2017 | Yamashita | F01P 3/20 |
| 2017/0335756 | A1 * | 11/2017 | Donkin | F04D 25/045 |

FOREIGN PATENT DOCUMENTS

| | | | | |
|---|---|---|---|---|
| CN | 206874357 | U | 1/2018 | |
| EP | 0304259 | A1 * | 8/1988 | F02B 37/10 |
| EP | 3043073 | A1 | 7/2016 | |
| EP | 3249234 | A1 | 11/2017 | |
| WO | 2015128413 | A1 | 9/2015 | |

OTHER PUBLICATIONS

English EP-0304259 by PE2E Aug. 2, 2023.*

Great Britain Intellectual Property Office, Combined Search and Examination Report under Sections 17 and 18(3) Issued in Application No. GB2301164.6, dated May 26, 2023, 10 pages.

* cited by examiner

*Primary Examiner* — Deming Wan

(74) *Attorney, Agent, or Firm* — McCoy Russell LLP

(57) ABSTRACT

Various methods and systems are provided for an electric turbocharger. In one example, the electric turbocharger includes an electric motor circumferentially surrounding a shaft, a turbine coupled to a first end of the shaft, and a compressor coupled to a second end of the shaft, opposite of the first end. The compressor may include a volute with a curved portion protruding towards the turbine.

18 Claims, 6 Drawing Sheets

INVERTED COMPRESSOR FOR ELECTRIC TURBOCHARGER

BACKGROUND

Priority

The present application claims priority to U.S. Provisional Application No. 63/268,106, entitled "INVERTED COMPRESSOR FOR ELECTRIC TURBOCHARGER", and filed on Feb. 16, 2022. The entire contents of the above-listed application are hereby incorporated by reference for all purposes.

TECHNICAL FIELD

Embodiments of the subject matter disclosed herein relate to a compressor for turbocharger.

DISCUSSION OF ART

Vehicles may include an internal combustion engine to combust mixtures of fuel and air. In some examples, power output by the engine may be augmented by compressing intake air prior to combustion at the engine, thereby increasing air charge, e.g., a density of oxygen molecules, and allowing a corresponding amount of injected fuel to be increased. Compression of intake air may be achieved by implementing a turbocharger in the vehicle, with a compressor of the turbocharger coupled to an air intake system of the engine and a turbine of the turbocharger coupled to an exhaust system of the engine. The turbine and compressor are connected by a shaft and rotation of the turbine, which is driven by exhaust gas flow, may drive rotation of the compressor.

In some instances, replacement of a conventional turbocharger with an electric turbocharger, e.g., an e-turbo, may be desired. The e-turbo, however, may rely on an alternator coupled to the shaft that connects the turbine to the compressor. In order to accommodate positioning of the alternator along the shaft, changes to surrounding piping and/or components may be demanded, leading to increased costs and installation complexity. For example, a minimum length of the alternator that allows the alternator to meet power demands without overheating may demand an alternator length that is longer than a packaging space available between the turbine and the compressor. Attempts to address this issue include moving the compressor and turbine further apart or positioning the alternator outside of the turbocharger. Both approaches, however do not allow efficient replacement of the turbocharger with the e-turbo without time-consuming alterations to the turbocharger piping and surrounding components. It may be desirable to have a system and method that differs from those that are currently available.

BRIEF DESCRIPTION

In one embodiment, an electric turbocharger may include an electric motor circumferentially surrounding a shaft, a turbine coupled to a first end of the shaft, and a compressor coupled to a second end of the shaft, opposite of the first end, the compressor having a volute with a curved portion protruding towards the turbine, the curved portion curving along a central axis of rotation of the electric turbocharger.

In one embodiment, a method for assembling an electric turbocharger is provided. The method may include coupling an electric motor to a shaft; attaching each of a compressor and a turbine to opposite ends of the shaft with the electric motor positioned therebetween; and coupling a volute to the compressor by orienting a curved portion of the volute to protrude from an inlet of the volute along a central axis of rotation of the electric turbocharger in a direction from the compressor to the turbine, wherein the inlet of the volute is positioned further from the turbine than the curved portion of the volute.

In one embodiment, a turbocharger with an inverted volute is provided. The turbocharger may include a volute with an inlet aligned with a wheel of a compressor along a direction perpendicular to a central axis of rotation of the turbocharger, the inlet of the volute positioned further from a disc of a turbine than a curved inner cavity of the volute; and an alternator coupled to a shaft extending between the wheel of the compressor and the turbine, the alternator positioned closer to the wheel of the compressor than the disc of the turbine.

DETAILED DESCRIPTION

Figure 1:
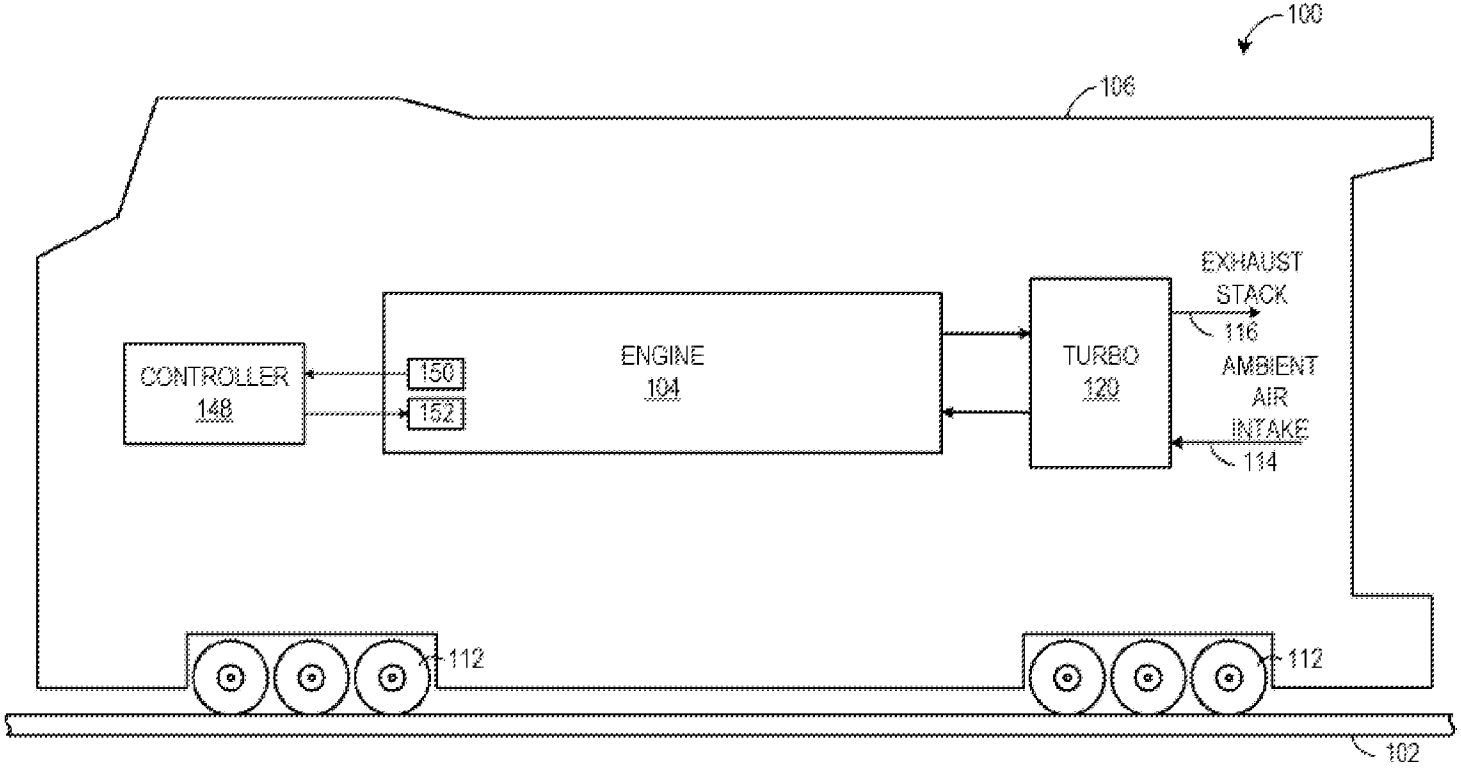
FIG. 1 shows an example embodiment of a vehicle having a turbocharger.

The following description relates to a turbocharger for a vehicle. Embodiments of the invention relate to an electric turbocharger with an inverted volute. This design may facilitate accommodation and positioning of an alternator along a shaft of the electric turbocharger.

Embodiments of the disclosure are disclosed in the following description, and may relate to methods and systems for a multi-fuel system of an internal combustion engine (ICE) comprising a turbocharger. The ICE may operate via a combination of different fuels. These fuels may have relatively different amounts of carbon. In one example, the ICE may be a multi-fuel engine configured to combust a plurality of fuels. Each of the plurality of fuels may be stored in separate fuel tanks. In one embodiment, one or more of the fuels and its corresponding fuel tank may be housed in a different fuel tank including a different fuel. In one example, a gaseous fuel tank comprising a gaseous fuel may be arranged within an interior volume of a liquid fuel tank comprising a liquid fuel.

The ICE may combust one or more of gasoline, diesel, hydrogenation-derived renewable diesel (HDRD), alcohol (s), ethers, ammonia, biodiesels, hydrogen, natural gas, kerosene, syn-gas, and the like. The plurality of fuels may include gaseous fuels, liquid fuels, and solid fuels, alone or in combination. A substitution rate of a primary fuel of the ICE with a secondary fuel may be determined based on a current engine load. In one embodiment, the substitution rate may correspond to an injection amount of a fuel with a relatively lower carbon content or zero carbon content (e.g., hydrogen gas or ammonia). As the substitution rate increases, the relative proportion of fuel with the lower or zero carbon content increases and the overall amount of carbon content in the combined fuel lowers. Additionally or alternatively, the substitution rate may correspond to an injection amount or delivery of a gaseous fuel relative to a liquid fuel.

In one example, the ICE may combust fuels that include both diesel and hydrogen. During some operating modes, the ICE may combust only diesel, only hydrogen, or a combination thereof (e.g., during first, second, and third conditions, respectively). When hydrogen is provided, operating conditions may be adjusted to promote enhanced combustion of the hydrogen. The engine system may combust a mixture of three or more fuels including diesel, hydrogen, and ammonia. Additionally or alternatively, ethanol may be included in the combustion mixture.

In one example, systems and methods for the multi-fuel engine may include combusting a primary fuel in combination with one or more secondary fuels. The multi-fuel engine may combust the primary fuel alone. During some conditions, the multi-fuel engine may decrease an amount of primary fuel used via substituting one or more secondary fuels into a combustion mixture. The secondary fuels may include a reduced carbon-content relative to the primary fuel. Additionally or alternatively, the secondary fuels may be less expensive, more available, and/or more efficient. The secondary fuels may vary in ignitibility and burn rate. An ignition timing of the multi-fuel engine may be adjusted in response to the combustion mixture to account for inclusion of the secondary fuels. For example, the ignition timing may be retarded as an amount of hydrogen is increased. As another example, the ignition timing may be advanced as an amount of ammonia is increased. The ignition timing may be further adjusted in this way in response to addition and subtraction of the primary and one or more secondary fuels to the combustion mixture. By doing this, knock and pre-combustion may be mitigated.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

Before further discussion of the methods and systems for accommodating an electric turbocharger in a vehicle, an example platform in which the methods may be implemented is shown. FIG. 1 depicts an exemplary embodiment of a vehicle system 100 (e.g., a locomotive system), shown as a rail vehicle 106. The rail vehicle runs on a rail 102 via a plurality of wheels 112 and includes an engine system with an engine 104. The engine receives intake air for combustion through an intake passage 114 which receives ambient air from outside of the rail vehicle. Exhaust gas generated during combustion at the engine is supplied to an exhaust passage 116 and flows out of an exhaust stack of the rail vehicle.

The engine system includes a turbocharger 120 arranged between the intake passage and the exhaust passage. The turbocharger increases air charge of ambient air drawn in the intake passage in order to provide greater charge density during combustion to increase power output and/or engine-operating efficiency. The turbocharger may include a compressor (not shown in FIG. 1) which is at least partially driven by a turbine (not shown in FIG. 1). While a single turbocharger is shown, the engine system may include multiple turbine and/or compressor stages.

In one example, the turbocharger may be an electric turbocharger (e-turbo). The e-turbo includes an electric motor used to drive rotation of a shaft of the turbocharger, the shaft coupling the compressor to the turbine. By incorporating the electric motor, turbocharger issues, such as turbo lag, for example, may be alleviated while increasing the vehicle's fuel efficiency. Furthermore, the electric motor may, in some examples, operate as a generator to harvest excess power at the e-turbo and convert the excess power to electrical energy. In some instances, retrofitting of a vehicle, formerly utilizing a non-electrical turbocharger, with the e-turbo may be desirable. Strategies for adapting the e-turbo to a vehicle are discussed further below, with reference to FIGS. 2-5.

In some examples, the vehicle system may further include an exhaust gas treatment system coupled in the exhaust passage upstream or downstream of the turbocharger. For example, the exhaust gas treatment system may include a diesel oxidation catalyst (DOC) and a diesel particulate filter (DPF), as well as one or more emission control devices. The emission control devices may include a selective catalyst reduction (SCR) catalyst, a three-way catalyst, a NOx trap, etc.

The rail vehicle also includes a controller 148 to control various components related to the vehicle system. In one example, the controller includes a computer control system and computer readable storage media including code for enabling on-board monitoring and control of vehicle operation. The controller, while overseeing control and management of the vehicle system, may receive signals from a variety of engine sensors 150 in order to determine operating parameters and operating conditions, and correspondingly adjust various engine actuators 152 to control operation of the rail vehicle.

As described above, implementation of the e-turbo in the engine system of the vehicle may be desired, either as a newly assembled vehicle or retrofit to a vehicle with an already existing, e.g., original, turbocharger for which replacement is desired. Installing the e-turbo in place of the original turbocharger however, may present challenges with respect to packaging space for the e-turbo. For example, direct coupling of an electric motor, e.g., an alternator, to the e-turbo shaft may be desirable to maintain a compact design, configuration and high efficiency of the e-turbo. The alternator dimensions may adhere to a target length that optimizes power output and heat generation. The target length, however, may be longer than a length of a shaft extending between a compressor wheel and a turbine disc of the original turbocharger. In some examples, an available packaging space for the e-turbo, when adapted for the original turbocharger, may not allow an axial length of the e-turbo to be increased relative to the original turbocharger to accommodate the target axial length of the alternator. Furthermore, maintaining a distance between the compressor and turbine according to that of the original turbocharger may cause the alternator to impinge on a conical portion of a turbine diffusor that extends between the turbine and compressor, when the alternator is coupled to the shaft.

Approaches to address the issues described above include extending the length of the shaft, relative to the original turbocharger, to position the compressor and turbine further apart, or locating the alternator outside of (e.g., exterior to) the turbocharger, such as in front of the compressor. Both of these strategies, however, demand extensive and costly modifications to piping coupled to the e-turbo as well as to surrounding components.

Figure 2:
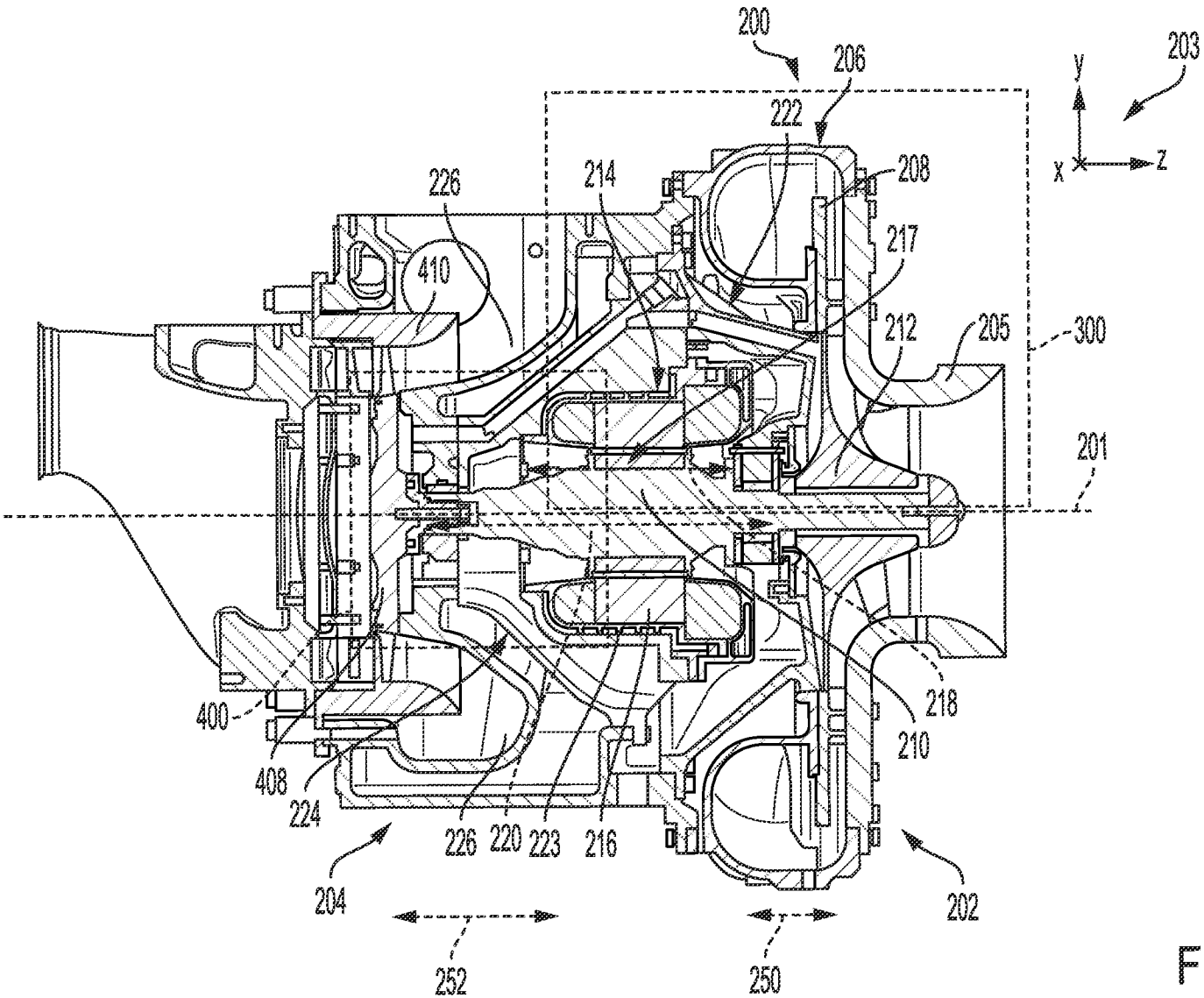
FIG. 2 shows a cross-section of an axial electric turbocharger having an inverted volute, according to an exemplary embodiment.
Figure 4:
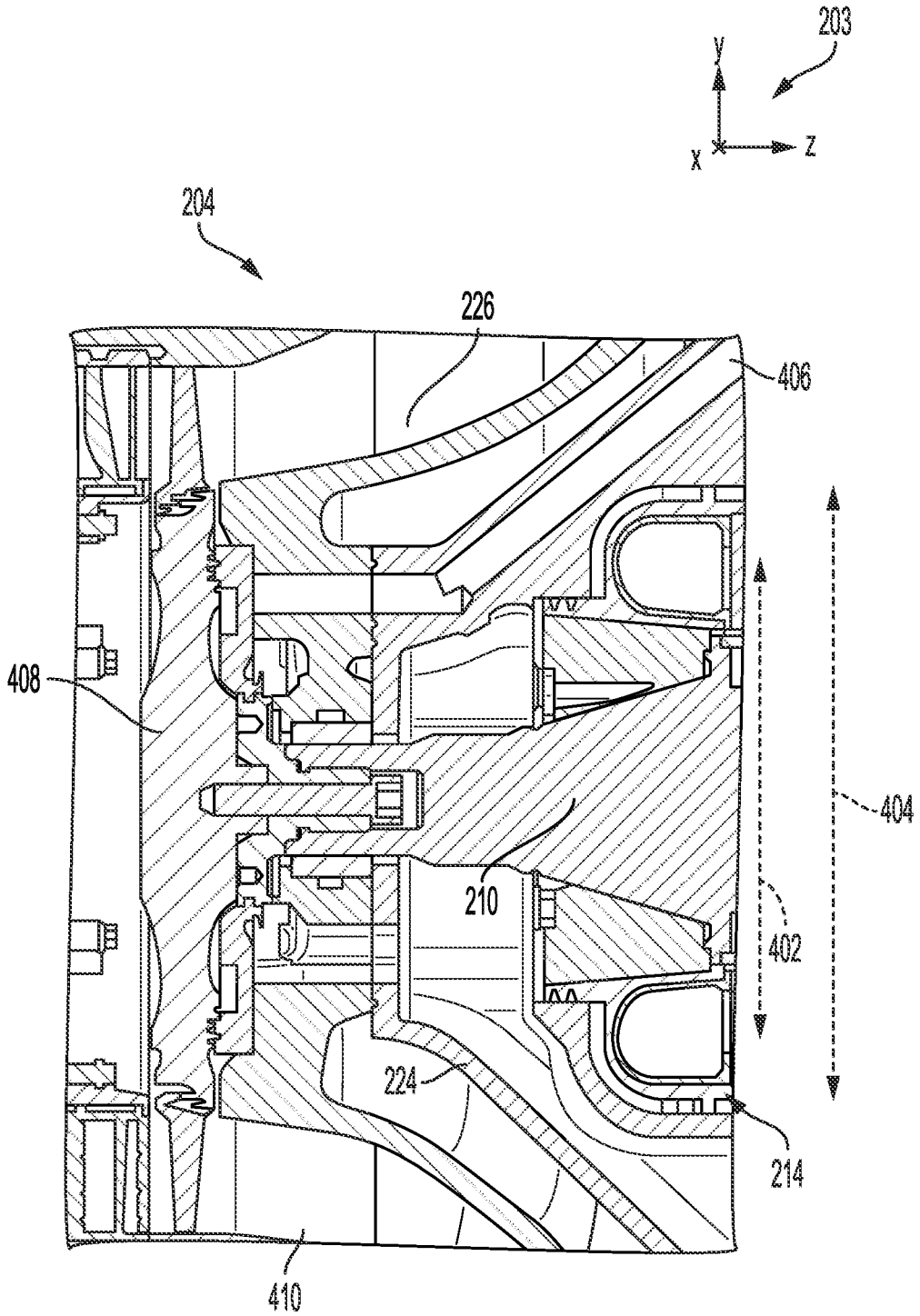
FIG. 4 shows a detailed view of a second region of the cross-section of FIG. 3.
Figure 5:
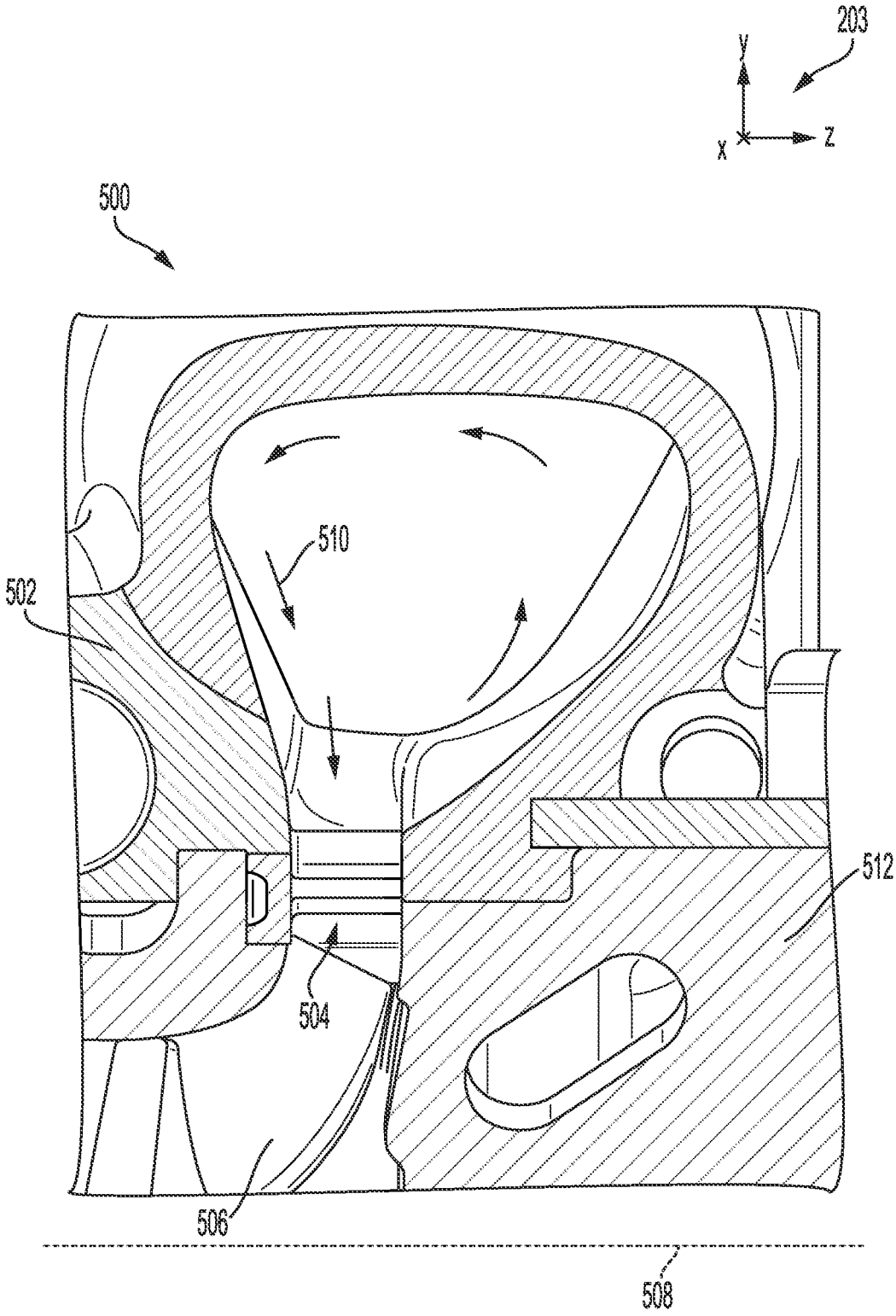
FIG. 5 shows a cross-section of a portion of a radial electric turbocharger having an inverted volute, according to an exemplary embodiment.
Figure 6:
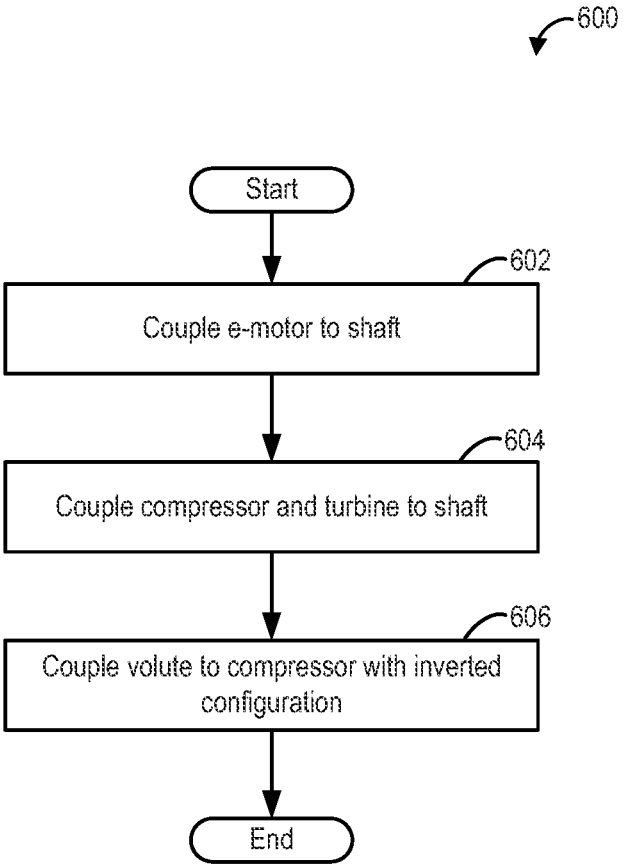
FIG. 6 shows an example of a method for assembling an electric turbocharger having an inverted volute.

In one example, the e-turbo may be incorporated into the vehicle without incurring time-consuming and costly adjustments by inverting one or more of a compressor volute and a turbine volute of the e-turbo. For example, the compressor volute may be inverted for an axial e-turbo and at least one of the compressor volute and the turbine volute may be inverted for a radial e-turbo. With the volute inverted relative to the compressor and/or the turbine, a distance between the compressor and turbine may be increased without a corresponding increase in overall size of the e-turbo. An example of an axial e-turbo with an inverted compressor volute is illustrated in FIG. 2, with specific portions of the e-turbo depicted in magnified views in FIGS. 3 and 4. An example of a turbine of a radial e-turbo, the turbine having an inverted volute, is shown in FIG. 5. A method for assembling an e-turbo, such as the e-turbo shown in FIGS. 2-4 is depicted in FIG. 6.

Turning now to FIG. 2, a cross-section of an e-turbo 200 is shown, having a compressor 202 and a turbine 204, coupled to one another by a shaft 210. The e-turbo 200 also has a central axis of rotation 201. A set of references axes 203 are provided, indicating a y-axis, an x-axis, and a z-axis. The compressor has an inlet 205 coupled to a volute 206, the volute enclosing a diffusor 208. The volute may be inverted, e.g., flipped along the central axis of rotation and across the y-axis, relative to conventional turbocharger configurations, resulting in the volute having a backwards "P" shape (e.g., when viewed in the cross-section with the compressor located to a right side and the turbine located at a left side of the e-turbo).

Figure 3:
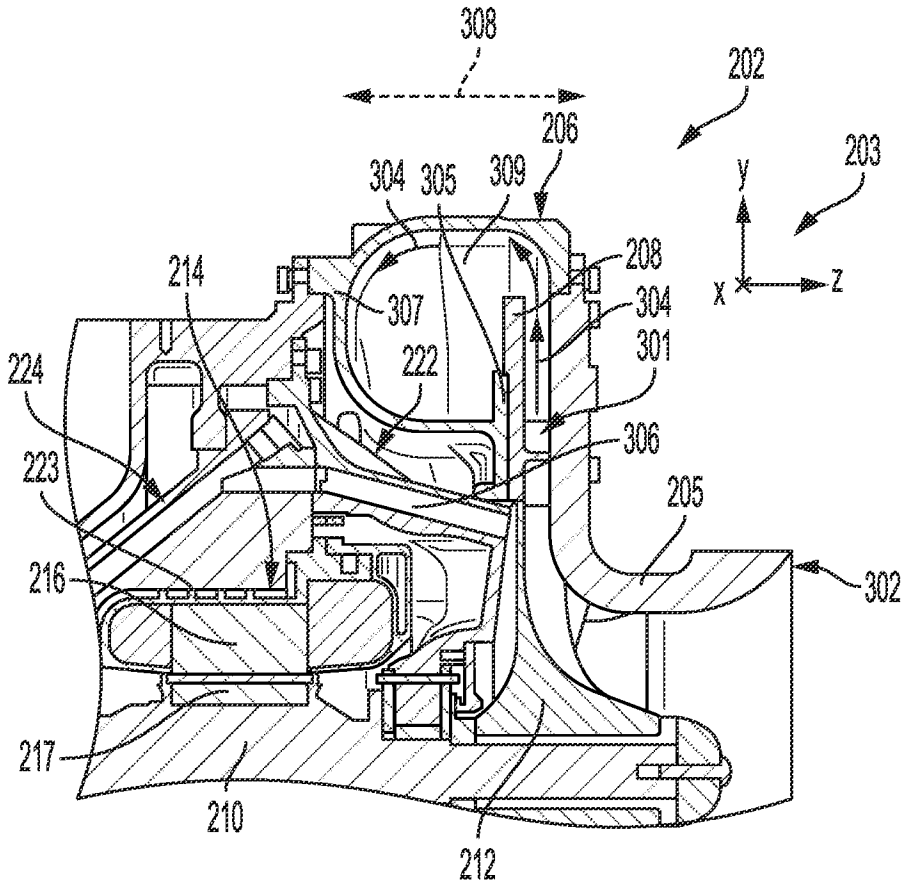
FIG. 3 shows a detailed view of a first region of the cross-section of FIG. 2.

For example, as shown in FIG. 3 in a detailed view of region 300 indicated in FIG. 2, an inlet 301 of the volute, which includes the diffusor, is aligned with an edge of a compressor wheel 212 along the y-axis. The inlet of the volute extends linearly and perpendicularly away from the central axis of rotation between a vertical portion (e.g., vertical with respect to the y-axis) of a compressor inlet 302 and an inner surface 305 of a casing 307 of the volute. The casing of the volute curves to the left, e.g., towards the turbine, to enclose a cavity 309 of the volute within a curved portion of the casing. The curved portion of the casing protrudes in a direction along the central axis of rotation from the compressor to the turbine and circumferentially surrounds a compressor bearing carrier 222.

Air entering the compressor via the compressor inlet flows between the vertical portion of the compressor inlet and the diffusor, upwards along the y-axis, as indicated by arrows 304. The air flows along an inner surface of the volute, e.g., curving to the left as shown in FIG. 3, and flows radially around the compressor before being directed to an intake manifold of an engine.

As shown in FIGS. 2 and 3, an alternator 214 of an electric motor is coupled to the shaft of the e-turbo. The alternator may include a stator 216 circumferentially surrounding the shaft and a rotor 217 in direct contact with the shaft. A helical water jacket 223 may surround the stator. The alternator has a length 218 that is less (e.g., shorter) than a length 220 of the shaft, the lengths indicated in FIG. 2. The alternator is not centered along the length of the shaft and is instead biased to be further from a right end (e.g., a compressor end) of the shaft than a left end (e.g., a turbine end) of the shaft. The biasing of the alternator accommodates positioning of compressor and turbine components around the alternator, as described below.

The compressor bearing carrier is positioned between the alternator and the compressor wheel, along the central axis of rotation. Further, the compressor bearing carrier is nested within an inner space of the volute casing such that the compressor bearing carrier is circumferentially surrounded by the volute casing. At least a portion of the compressor bearing carrier may be spaced away from the volute casing. As shown in FIG. 3, the compressor bearing carrier includes at least one channel 306 for receiving buffer air from the compressor inlet. As such, the compressor bearing carrier is directly adjacent to the compressor wheel and together, the compressor bearing carrier and the compressor wheel occupy a portion of the length of the shaft representing the compressor end.

Inversion of the volute of the compressor allows a distance between the compressor wheel and the turbine to be increased by a width 308 of the volute, as shown in FIG. 3. For example, the compressor wheel is shifted away from the turbine along the central axis of rotation by the width of the volute in order to maintain the alignment of the compressor wheel with the diffusor. The compressor inlet is similarly shifted away from the turbine. In one example, the width of the volute is approximately 5.7 inches, allowing the compressor wheel to be distanced further from the turbine by approximately 5.7 inches relative to when the volute is not inverted. As another example, the compressor wheel may be displaced an additional distance from the turbine, compared to configurations where the volute is not inverted, by at least 5 inches.

The increased distance between the compressor and the turbine allows the alternator to be located therebetween without impinging on a conical turbine diffusor 224, as shown in FIG. 2. The conical turbine diffusor extends along the central axis of rotation in a direction from the turbine to the compressor, while flaring outwards and away from the central axis of rotation. For example, as shown in FIG. 4, a diameter 402 of the conical turbine diffusor increases along the central axis of rotation in a direction from the turbine to the compressor, the diameter indicated in FIG. 4.

Turning now to FIG. 4, a region 400 indicated in FIG. 2 is shown in greater detail in FIG. 4. The diameter of the conical turbine diffusor at a narrowest region of the conical turbine diffusor is narrower than a diameter 404 of the alternator. The conical turbine diffusor includes one or more channels 406, e.g., cross-drillings, for delivering buffer air to a turbine disc 408 and oil to a turbine bearing 410 at the turbine end of the shaft from the compressor inlet. For example, the cross-drillings may be continuous across the compressor and the turbine. As shown in FIGS. 2 and 4, positioning of the conical turbine diffusor proximate to the turbine disc, as well as adjacent to the compressor bearing carrier, may therefore be demanded. The increased distance between the compressor and turbine, enabled by inversion of the volute, may provide sufficient packaging space for the alternator to mitigate impinging of the alternator on the conical turbine diffusor. As an example, the alternator is shifted to the right in FIGS. 2-4 relative to configurations where the volute is not inverted, and spaced away from the turbine disc by a portion of the conical turbine diffusor and a portion of a water jacket 226 surrounding the conical turbine diffusor. For example, in the configurations where the volute is not inverted, shifting of the alternator to the left relative to the positioning shown in FIG. 2-4 may be demanded, which is blocked by a narrowness of the conical turbine diffusor diameter unless a distance between the turbine and the compressor is increased along the shaft.

The alternator may be located closer to the compressor wheel than to the turbine disc, as a result of a position the alternator with respect to the conical turbine diffusor. For example, a first distance 250 between the alternator and the compressor wheel may be smaller than a second distance 252 between the alternator and the turbine disc, as shown in FIG. 2. A first portion of a length of the alternator, the length defined along the central axis of rotation may be enclosed within the conical turbine diffusor and a second portion of the length of the alternator may be enclosed within the compressor wheel. The first portion may be 50% or greater of the length of the alternator while the second portion may be 50% or less of the length of the alternator. In some examples, the first portion is larger than the second portion.

Shifting of the alternator to circumvent impingement on the conical turbine diffusor is enabled by inverting the volute, thereby opening up additional axial space between the compressor wheel and the turbine disc for a given shaft length. Further, available packaging space for positioning the alternator far enough away from the turbine disc is also provided along the shaft between the compressor and turbine by partially enclosing the alternator within the conical turbine diffusor. The available packaging space within the turbocharger may also accommodate positioning of the water jacket around the conical turbine diffusor, as shown in FIGS. 2 and 4.

The water jacket may include cavities and channels for flowing a coolant therethrough for moderating a temperature of the conical turbine diffusor and the turbine bearing. In one example, the water jacket may be fluidically coupled to a coolant circuit of the vehicle that also delivers the coolant to the helical water jacket of the stator. The coolant may be flowed at low velocity through the water jacket of the turbine and at high velocity through the helical water jacket of the stator. The water jacket may circumferentially surround the conical turbine diffuser, in contact with the conical turbine diffusor, and an end of the water jacket may be contiguous with the curved portion of the casing of the volute. As the water jacket may be a relatively large structure, efficient packaging of the turbocharger, e.g., as provided by the inverted volute, may allow a volume of the water jacket to be at least maintained, or even increased, in some examples without increasing an overall footprint of the e-turbo.

As described above, in instances where the e-turbo has a radial configuration, a volute of turbine of the e-turbo may additionally or alternatively be inverted. For example, a cross-section of a portion of a turbine 500 for a radial e-turbo is illustrated in FIG. 5. The e-turbo may be oriented similar to the e-turbo of FIGS. 2-4, with the turbine located on the left and the compressor located on the right. The cross-section is also sliced along the y-z plane.

A volute 502 of the turbine, which may form a portion of a casing of the turbine, may have an inlet 504 that is aligned with a mid-point along an edge of a turbine wheel blade 506. At least a portion of the inlet 504 may be coupled to a turbine shroud 512. The inlet may be shifted to the left, e.g., further from the compressor relative to a turbine with a volute that is not inverted. The volute may have a cross-sectional geometry resembling a "P". Gas flowing into the volute through the inlet may curve to the left, along a central axis of rotation 508 of the turbine, as indicated by arrows 510, while flowing in a radial direction through the volute.

By inverting the turbine, packaging space between the turbine and the compressor may be increased. In some examples, a volute of the compressor may also be inverted, as described above with reference to FIGS. 2-4, which may further increase the available space between the turbine and the compressor, along a shaft of the e-turbo. As such, for the radial e-turbo, accommodation of an alternator positioned between the turbine and the compressor may be enabled by inverting one or more of the compressor volute and the turbine volute.

An example of a method 600 for assembling an e-turbo is shown in FIG. 6, where the e-turbo may be either the e-turbo of FIGS. 2-4 or of FIG. 5. The method may be executed at a production or manufacturing facility by both manual and automated techniques. At step 602 of the method, an electric motor, such as an alternator, is coupled to a shaft of the e-turbo. For example, a rotor of the electric motor may be arranged in direct contact with the shaft and a stator of the electric motor may be positioned around the rotor. A compressor of the e-turbo may be similar, whether the e-turbo has an axial or radial configuration. A turbine of the e-turbo may differ according to the e-turbo type, however, where the turbine of the axial e-turbo has a conical turbine diffusor and the turbine of the radial e-turbo has a volute.

At step 604 of the method, each of the compressor and the turbine may be coupled to the shaft. For example, for the axial e-turbo, a wheel and a bearing of the compressor may be attached to a first end of the shaft and a disc, a bearing, and the conical turbine diffusor of the turbine may be attached to a second, opposite end of the shaft. The alternator may be positioned between the bearing of the compressor and the disc of the turbine. A portion of the alternator may be enclosed within the conical turbine diffusor. A remaining portion of the alternator that is not located inside of the conical turbine diffusor may be enclosed by the compressor bearing carrier. For example, the alternator may be partially enclosed by the conical turbine diffusor and partially enclosed by the compressor bearing carrier. The conical turbine diffusor and the compressor bearing carrier may be in contact with one another at respective ends thereof. As an example, an end of the conical turbine diffusor may be contiguous with an end of the compressor bearing carrier. For the radial e-turbo, the compressor may be similarly coupled to the first end of the shaft. A turbine wheel and a turbine shroud may be attached to the second end of the shaft, instead of the disc, bearing, and conical turbine diffusor.

At step 606 of the method, a volute is coupled to the compressor in an inverted configuration. For example, the volute may be oriented with an inlet of the volute aligned with an edge of the compressor wheel along a direction perpendicular to the central axis of rotation. A cross-section of the volute (sliced along a plane parallel with the central axis of rotation with the compressor on the right and the turbine on the left), may have a backwards "P" shape. As such, a curved portion of the volute that curves along the central axis of rotation may be located to a side of the volute inlet proximate to the turbine such that the curved portion is closer to the turbine than the inlet of the volute. Air entering the volute through the inlet may therefore flow in a direction along the central axis of rotation towards the turbine, within the curved portion of the volute. At least the curved portion of the volute may circumferentially surround the bearing of the compressor.

When the e-turbo is the radial e-turbo, an additional volute may be coupled to the turbine, also in an inverted configuration. For example, the volute may be oriented with an inlet of the volute aligned with a mid-point of a blade of wheel of the turbine. A cross-section of the volute (also sliced along the plane parallel with the central axis of rotation with the compressor on the right and the turbine on the left) may have a "P" shape. As such, a curved portion of the volute that curves along the central axis of rotation may curve to a right side of the inlet of the volute, towards the compressor. Gas entering the volute through the inlet may therefore flow in a direction along the central axis of rotation towards the compressor, within the curved portion of the volute.

A turbocharger may thereby receive an electric motor, such as an alternator, by adjusting an orientation of a compressor volute without demanding extensive modifications to the turbocharger, such as a longer shaft, or to surrounding vehicle components. As a result, costs of implementing an e-turbo may be reduced. By inverting the volute, packaging space along a shaft of the turbocharger may be increased, allowing the alternator to be coupled to the shaft without adversely affecting operation of the turbocharger components. Optimal dimensions of the alternator for efficiency, heat control, and longevity are thereby maintained.

As used herein, an element or step recited in the singular and proceeded with the word "a" or "an" do not exclude plural of said elements or steps, unless such exclusion is indicated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects. As used herein, the term "approximately" is means plus or minus five percent of a given value or range unless otherwise indicated.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

The disclosure also provides support for an electric turbocharger, comprising: an electric motor circumferentially surrounding a shaft, a turbine coupled to a first end of the shaft, and a compressor coupled to a second end of the shaft, opposite of the first end, the compressor having a volute with a curved portion protruding towards the turbine, the curved portion curving along a central axis of rotation of the electric turbocharger. In a first example of the system, the electric motor is an alternator that can rotate the shaft. In a second example of the system, optionally including the first example, an inlet of the volute is aligned along a direction perpendicular to the central axis of rotation with an edge of a compressor wheel. In a third example of the system, optionally including one or both of the first and second examples, the inlet of the volute is positioned further from the turbine than the curved portion of the volute. In a fourth example of the system, optionally including one or more or each of the first through third examples, a first portion of the electric motor is enclosed within a conical diffusor of turbine and a second portion of the electric motor is enclosed within a bearing of the compressor. In a fifth example of the system, optionally including one or more or each of the first through fourth examples, the first portion is larger than the second portion. In a sixth example of the system, optionally including one or more or each of the first through fifth examples, a bearing of the compressor is contact with a conical diffusor of the turbine along respective ends of the bearing and the conical diffusor. In a seventh example of the system, optionally including one or more or each of the first through sixth examples, the electric turbocharger is an axial turbocharger and a conical diffusor of the turbine has a larger diameter at a first end proximate to the compressor than a second end distal to the compressor.

The disclosure also provides support for a method for assembling an electric turbocharger, comprising: coupling an electric motor to a shaft, attaching each of a compressor and a turbine to opposite ends of the shaft with the electric motor positioned therebetween, and coupling a volute to the compressor by orienting a curved portion of the volute to protrude from an inlet of the volute along a central axis of rotation of the electric turbocharger in a direction from the compressor to the turbine, wherein the inlet of the volute is positioned further from the turbine than the curved portion of the volute. In a first example of the method, the electric motor is positioned between and partially enclosed by each of a conical turbine diffusor and a compressor bearing carrier. In a second example of the method, optionally including the first example, an end of the conical turbine diffusor is continuous with an end of the compressor bearing carrier and cross-drillings extend continuously from the compressor bearing carrier into the conical turbine diffusor and a turbine disc. In a third example of the method, optionally including one or both of the first and second examples, attaching the turbine to one of the opposite ends of the shaft includes circumferentially surrounding a conical turbine diffusor with a water jacket. In a fourth example of the method, optionally including one or more or each of the first through third examples, an end of the water jacket is contiguous with the curved portion of the volute. In a fifth example of the method, optionally including one or more or each of the first through fourth examples, the curved portion of the volute circumferentially surrounds a compressor bearing carrier.

The disclosure also provides support for a turbocharger with an inverted volute, comprising: a volute with an inlet aligned with a wheel of a compressor along a direction perpendicular to a central axis of rotation of the turbocharger, the inlet of the volute positioned further from a disc of a turbine than a curved inner cavity of the volute, and an alternator coupled to a shaft extending between the wheel of the compressor and the turbine, the alternator positioned closer to the wheel of the compressor than the disc of the turbine. In a first example of the system, a diffusor of the volute is aligned with the wheel of the compressor along the direction perpendicular to the central axis of rotation. In a second example of the system, optionally including the first example, the turbocharger is an axial turbocharger with a conical turbine diffusor, and wherein the alternator is spaced away from the disc of the turbine by a portion of the conical turbine diffusor and a portion of a water jacket surrounding the conical turbine diffusor. In a third example of the system, optionally including one or both of the first and second examples, the turbocharger is a radial turbocharger and a volute of the turbine has an inverted orientation. In a fourth example of the system, optionally including one or more or each of the first through third examples, the compressor is shifted further from the turbine relative to a turbocharger with a volute that is not inverted. An exemplary shift may be 5 inches or more, depending on application specific parameters. In a fifth example of the system, optionally including one or more or each of the first through fourth examples, a greater portion of the alternator is enclosed within the turbine than within the compressor.

This written description uses examples to disclose the invention, including the best mode, and also to enable a person of ordinary skill in the relevant art to practice the invention, including making and using devices or systems and performing the incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. An electric turbocharger, comprising:

an electric motor circumferentially surrounding a shaft;

a turbine coupled to a first end of the shaft;

a conical diffusor of the turbine partially enclosing the electric motor; and a compressor coupled to a second end of the shaft, opposite of the first end, the compressor having a volute with a curved portion protruding towards the turbine, the curved portion curving along a central axis of rotation of the electric turbocharger.

2. The electric turbocharger of claim 1, wherein the electric motor is an alternator configured to rotate the shaft.

3. The electric turbocharger of claim 1, wherein an inlet of the volute is aligned with an edge of a compressor wheel along a direction perpendicular to the central axis of rotation.

4. The electric turbocharger of claim 3, wherein the inlet of the volute is positioned further from the turbine than the curved portion of the volute.

5. The electric turbocharger of claim 1, wherein a first portion of the electric motor is enclosed within the conical diffusor of the turbine and a second portion of the electric motor is enclosed within a bearing of the compressor.

6. The electric turbocharger of claim 5, wherein the first portion is larger than the second portion.

7. The electric turbocharger of claim 1, wherein a bearing of the compressor is contact with the conical diffusor of the turbine along respective ends of the bearing and the conical diffusor.

8. The electric turbocharger of claim 1, wherein the electric turbocharger is an axial turbocharger and the conical diffusor of the turbine has a larger diameter at a first end proximate to the compressor than a second end distal to the compressor.

9. A method for assembling an electric turbocharger, comprising:

coupling an electric motor to a shaft with the electric motor partially enclosed by a conical turbine diffusor;

attaching each of a compressor and a turbine to opposite ends of the shaft with the electric motor positioned therebetween; and coupling a volute to the compressor by orienting a curved portion of the volute to protrude from an inlet of the volute along a central axis of rotation of the electric turbocharger in a direction from the compressor to the turbine, wherein the inlet of the volute is positioned further from the turbine than the curved portion of the volute.

10. The method of claim 9, wherein the electric motor is positioned between and partially enclosed by each of the conical turbine diffusor and a compressor bearing carrier.

11. The method of claim 10, wherein an end of the conical turbine diffusor is continuous with an end of the compressor bearing carrier and cross-drillings extend continuously from the compressor bearing carrier into the conical turbine diffusor and a turbine disc.

12. The method of claim 9, wherein attaching the turbine to one of the opposite ends of the shaft includes circumferentially surrounding the conical turbine diffusor with a water jacket.

13. The method of claim 12, wherein an end of the water jacket is contiguous with the curved portion of the volute.

14. The method of claim 9, wherein the curved portion of the volute circumferentially surrounds a compressor bearing carrier.

15. A turbocharger with an inverted volute, comprising:

a volute with an inlet aligned with a wheel of a compressor along a direction perpendicular to a central axis of rotation of the turbocharger, the inlet of the volute positioned further from a disc of a turbine than a curved inner cavity of the volute; and an alternator coupled to a shaft extending between the wheel of the compressor and the turbine, the alternator positioned closer to the wheel of the compressor than the disc of the turbine, wherein the turbocharger is an axial turbocharger with a conical turbine diffusor, wherein the alternator is spaced away from the disc of the turbine by a portion of the conical turbine diffusor and a portion of a water jacket surrounding the conical turbine diffusor.

16. The turbocharger of claim 15, wherein a diffusor of the volute is aligned with the wheel of the compressor along the direction perpendicular to the central axis of rotation.

17. The turbocharger of claim 15, wherein the compressor is shifted further from the turbine by at least 5 inches relative to a turbocharger with a volute that is not inverted.

18. The turbocharger of claim 15, wherein a greater portion of the alternator is enclosed within the turbine than within the compressor.

* * * * *